US010791803B2

(12) United States Patent
Bevilacqua

(10) Patent No.: US 10,791,803 B2
(45) Date of Patent: Oct. 6, 2020

(54) RELEASE LEVER BUCKLE

(71) Applicant: NATIONAL MOLDING LLC, Miami Lakes, FL (US)

(72) Inventor: Miguel Bevilacqua, East Meadow, NY (US)

(73) Assignee: National Molding LLC, Miami Lakes, FL (US)

( * ) Notice: Subject to any disclaimer, the term of this patent is extended or adjusted under 35 U.S.C. 154(b) by 92 days.

(21) Appl. No.: 15/993,221

(22) Filed: May 30, 2018

(65) Prior Publication Data

US 2019/0216177 A1 Jul. 18, 2019

Related U.S. Application Data

(60) Provisional application No. 62/616,683, filed on Jan. 12, 2018.

(51) Int. Cl.
*A44B 11/26* (2006.01)
*A44B 11/25* (2006.01)

(52) U.S. Cl.
CPC ..... *A44B 11/266* (2013.01); *A44B 11/2526* (2013.01); *A44B 11/2592* (2013.01); *A44D 2211/00* (2013.01)

(58) Field of Classification Search
CPC .... F16B 45/02; F16G 11/048; A44B 11/2526; A44B 11/2592; A44B 11/266; A44D 2211/00
See application file for complete search history.

(56) References Cited

U.S. PATENT DOCUMENTS

| | | | | |
|---|---|---|---|---|
| 6,360,410 | B1 * | 3/2002 | Lovato | A44B 11/006 24/170 |
| 7,155,786 | B2 * | 1/2007 | Grimm | A44B 11/2592 24/647 |
| 8,522,410 | B2 * | 9/2013 | Parisi | A44B 11/2546 24/606 |
| 8,720,018 | B2 * | 5/2014 | Yoshie | A44B 11/266 24/615 |
| D735,075 | S * | 7/2015 | Hauserman | D11/216 |
| 9,072,344 | B2 * | 7/2015 | Yen | A44B 11/005 |
| 9,743,719 | B2 * | 8/2017 | Bevilacqua | A44B 11/2592 |
| 2007/0079486 | A1 * | 4/2007 | Paik | A44B 11/263 24/615 |

(Continued)

*Primary Examiner* — Robert Sandy
*Assistant Examiner* — David M Upchurch
(74) *Attorney, Agent, or Firm* — Sills Cummis & Gross; Jason Plotkin

(57) ABSTRACT

A buckle assembly including a first portion, a second portion, an actuator and a lever. The first portion includes a hollow body, an open top, a locking slot extending through the hollow body and a fulcrum. A second portion of the buckle includes a base opposite of a locking leg, the locking leg including a cavity, and a channel. Inserting the second portion into the hollow body through the open top of the first portion causes the locking leg to engage the locking slot and to lock the first portion to the second portion. An actuator slideably engaged to the channel and includes an arm slideably connected to the cavity. Applying a force to the actuator causes the arm to withdraw the locking leg, disengaging the locking leg from the locking slot. A lever is mounted on the fulcrum to apply the force to the actuator when the lever is pulled.

16 Claims, 9 Drawing Sheets

(56) References Cited

U.S. PATENT DOCUMENTS

| | | | | |
|---|---|---|---|---|
| 2009/0094809 | A1* | 4/2009 | Kung | A44B 11/25 24/625 |
| 2011/0219590 | A1* | 9/2011 | Anscher | A44B 11/266 24/606 |
| 2013/0205551 | A1* | 8/2013 | Wang | A44B 11/005 24/639 |
| 2014/0109360 | A1* | 4/2014 | Kelleghan | A44B 11/266 24/633 |
| 2014/0304955 | A1* | 10/2014 | Hortnagl | A44B 11/2573 24/595.1 |
| 2016/0166014 | A1* | 6/2016 | Soenen | A44B 11/2526 24/639 |
| 2016/0374432 | A1* | 12/2016 | Park | A43C 7/00 24/324 |

* cited by examiner

RELEASE LEVER BUCKLE

FIELD

Embodiments of this invention are directed to a buckle with a release lever mechanism for aiding in releasing said buckle.

BACKGROUND

Hikers, soldiers and outdoorsmen are often in situations where their equipment must be removed quickly. However, they may not be able to easily remove their equipment because of gloves, weather conditions or stress.

Additionally, some people who are handicapped may not possess sufficient dexterity to release an article from the device currently securing it.

Parents may need a device that securely holds an infant in a stroller or food chair that can be quickly and easily released.

Accordingly, there is a need for a buckle with an improved release mechanism that is quick and easy for a person with limited dexterity to use.

SUMMARY

An exemplary embodiment includes a buckle assembly including a first portion, a second portion, an actuator and a lever. The first portion includes a hollow body, an open end, at least one locking slot extending through the hollow body, at least one fulcrum and a receiving connector for a webbing. The second portion comprising one or more locking legs extending from a base, wherein each locking leg includes a cavity in a locking end, and a channel. The hollow body is sized to receive through the open end the first portion. The locking slot is sized to receive the locking end of the locking leg and to lock the first portion to the second portion. The actuator is slideably received in the channel and comprising a head and at least one arm connected to the head and slideably engages each cavity, such that applying a force to the actuator along a same axis as the channel causes the at least one arm to draw the at least one locking leg inwardly into an interior of the second portion and disengaging the locking leg from the locking slot. The lever mounted on the at least one fulcrum applies the force to the actuator along the same axis as the channel when the lever is pulled.

A method of locking a buckle including receiving in a first portion of the buckle a second portion of the buckle. The first portion includes a lever and a member attached to the lever and the second portion includes an actuator. Receiving in one or more locking slots in the first portion an equivalent number of locking legs and each locking leg is attached to the second portion. The lever is charged by applying a force from the actuator to the member.

A method of unlocking a buckle having at least two options for unlocking said buckle. A first option including applying a first force to a lever attached to a first portion of the buckle. The first force is substantially perpendicular to the lever and moves an actuator in contact with a member attached to the lever along a channel. The actuator retracts a locking leg from a locking slot, via an interaction between an arm of the actuator and a cavity in a locking end of the locking leg. The first portion includes the locking slot. A second portion includes the locking leg. A second option including applying a second force to the at least one locking leg until the at least one locking leg disengages from an equivalent number of locking slots thereby removing the second portion from the first portion.

DETAILED DESCRIPTION

While the presently disclosed invention is capable of being embodied in multiple different forms, the drawings illustrate a number of exemplary embodiments that are discussed in greater detail hereinafter. It should be clear to one having ordinary skill in the art that the figures and embodiments discussed herein are exemplary in nature, and are not intended to limit the invention to a specific illustrated embodiment.

In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

Buckles are used in many different applications and articles, including but not limited to, clothing, sporting gear, baggage, equipment. Buckle structures incorporating an easy to release function are particularly useful in military gear and law enforcement apparel.

Figure 1:
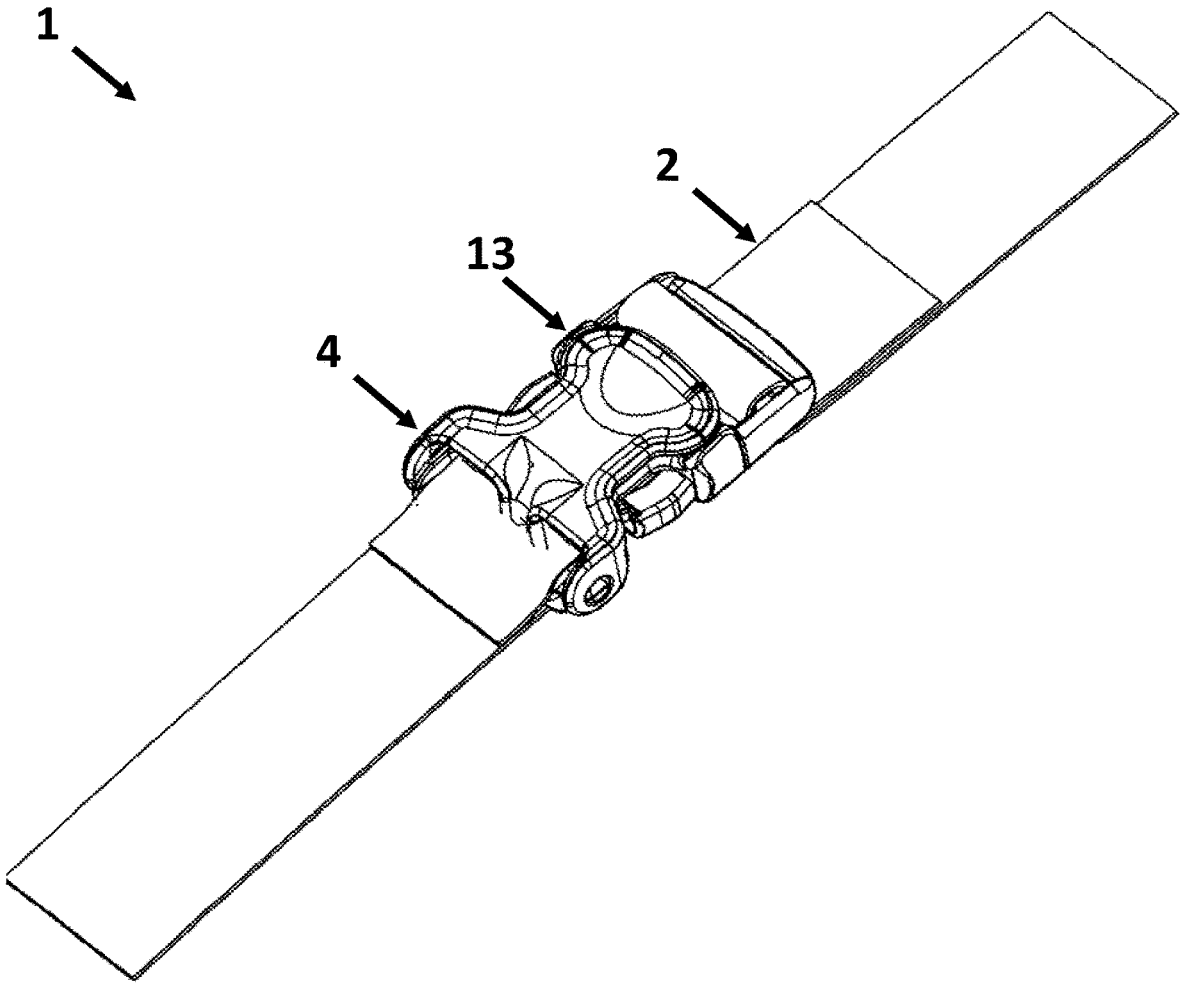
FIG. 1 is an exemplary illustration of a release lever buckle from an isometric perspective.

FIG. 1 is an exemplary embodiment of a buckle assembly 1 including a first portion 4 and a second portion 13 of a buckle that link together. One or both of the portions include interlocking components 7, 15, which are cooperatively structured to accomplish the release or separation of the portions. In more specific terms, a two-part buckle may typically include a female buckle or a first portion 4 component attached to one part of an article and a male connector or a second portion 13 attached to another part of the article. Further, the first portion 4 may be anchored to one end of a webbing 2, wherein the second portion 13 is connected to another end of a webbing 2.

Figure 2:
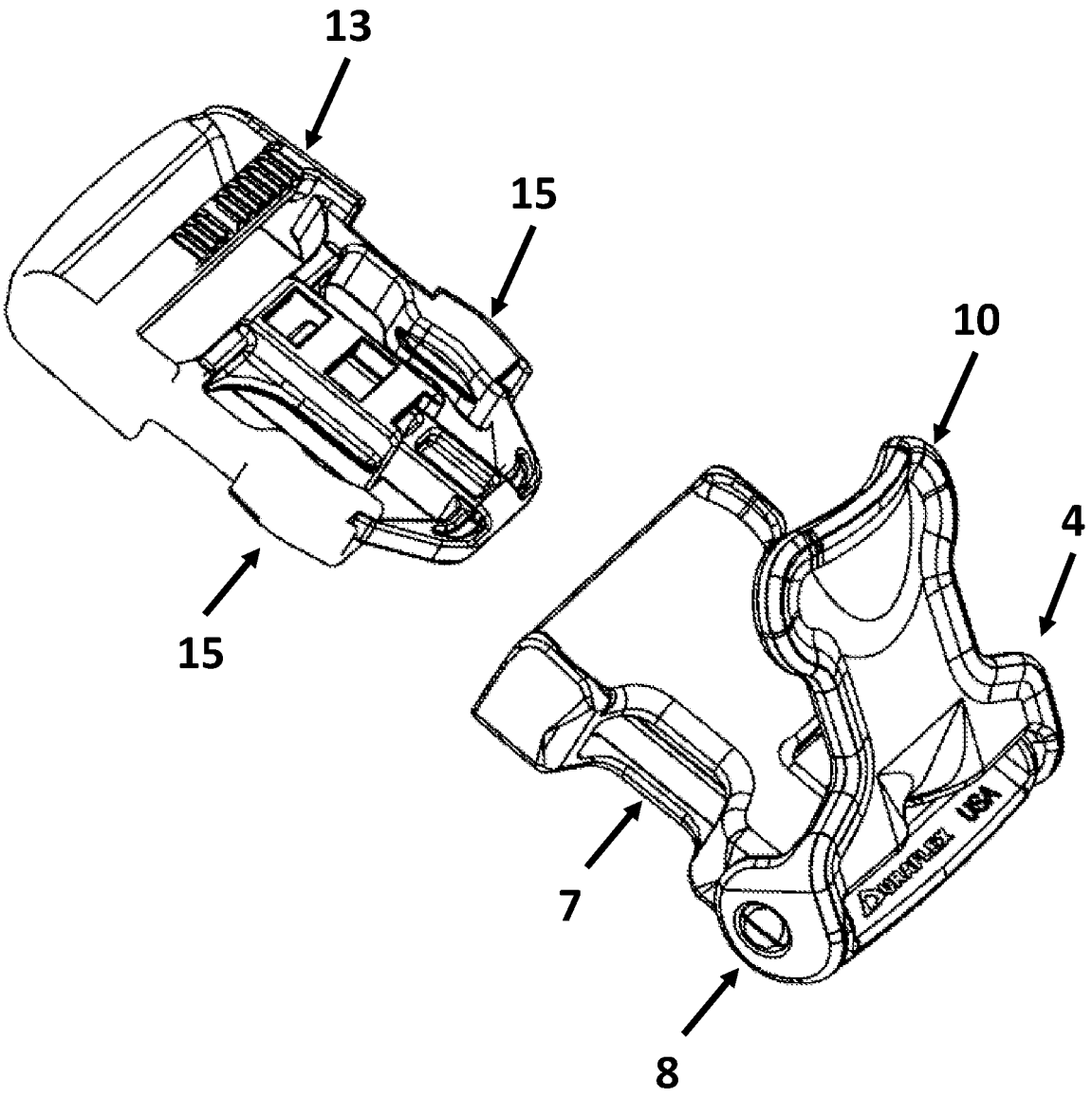
FIG. 2 is an exemplary illustration of a first and second portion of a release lever buckle disengaged from each other.
Figure 3:
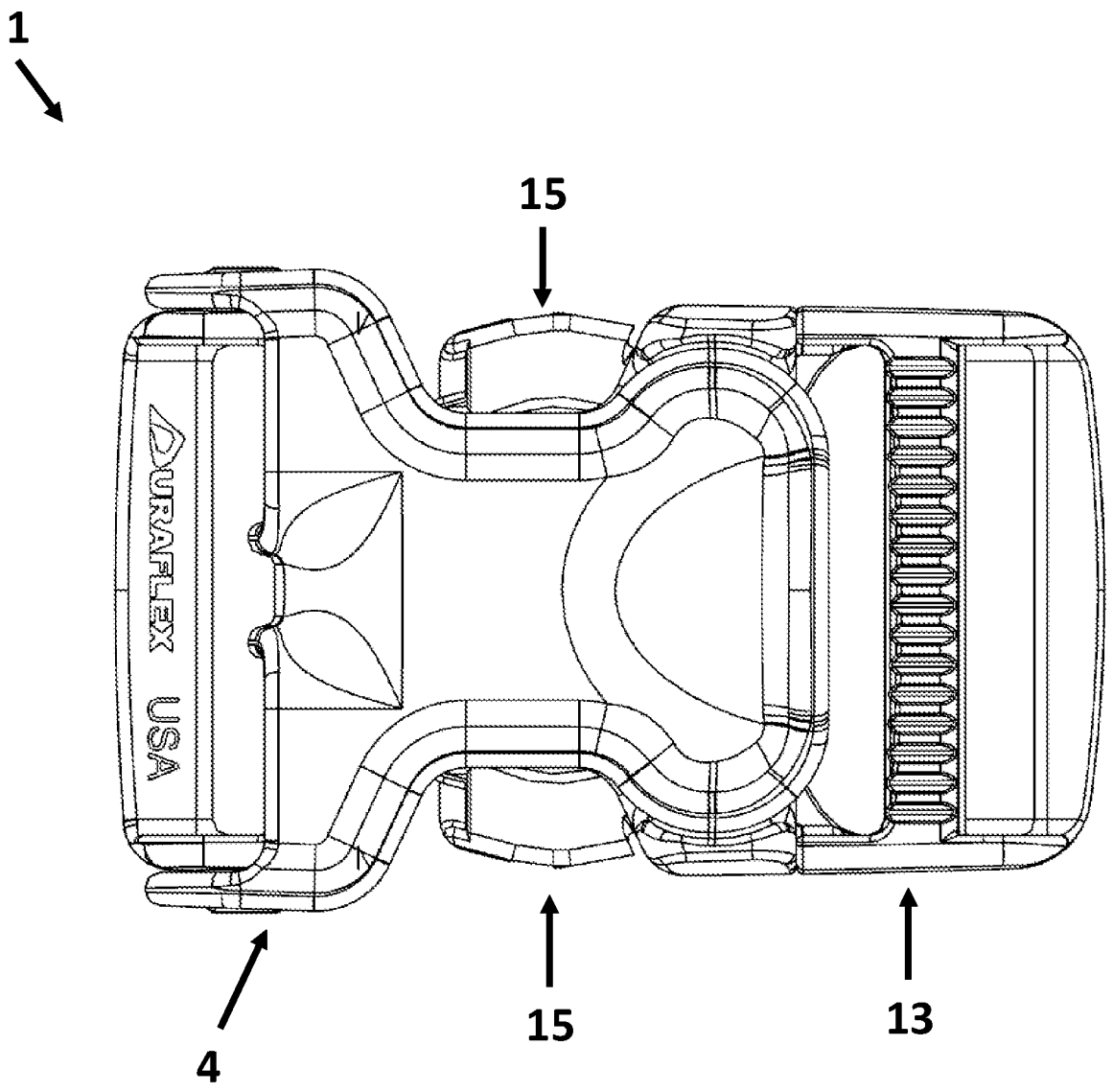
FIG. 3 is an exemplary illustration of a first and second portion of a release lever buckle engaged to each other.

Referring to FIGS. 2 and 3, the first portion 4 defines a substantially hollow body 5 or pocket into which the second portion 13 may be inserted. Various types of interlocking engagements are provided within the hollow body 5 of the first portion 4 of the buckle. For example, the interlocking engagements may include one or more of a locking slot 7 and a locking leg 15. Also, manipulation of at least one interlocking engagement serves to disconnect the inserted second portion 13 from the first portion 4.

Manipulating the interlocking engagement may be difficult in a combat or similar environment where the user is wearing gloves and is under a great amount of stress.

Additionally, users with a physical disability may lack sufficient dexterity or hand strength to manipulate the interlocking engagement. Accordingly, the current invention also includes an alternate release mechanism by a lever 10 that is easy to manipulate.

Figure 4:
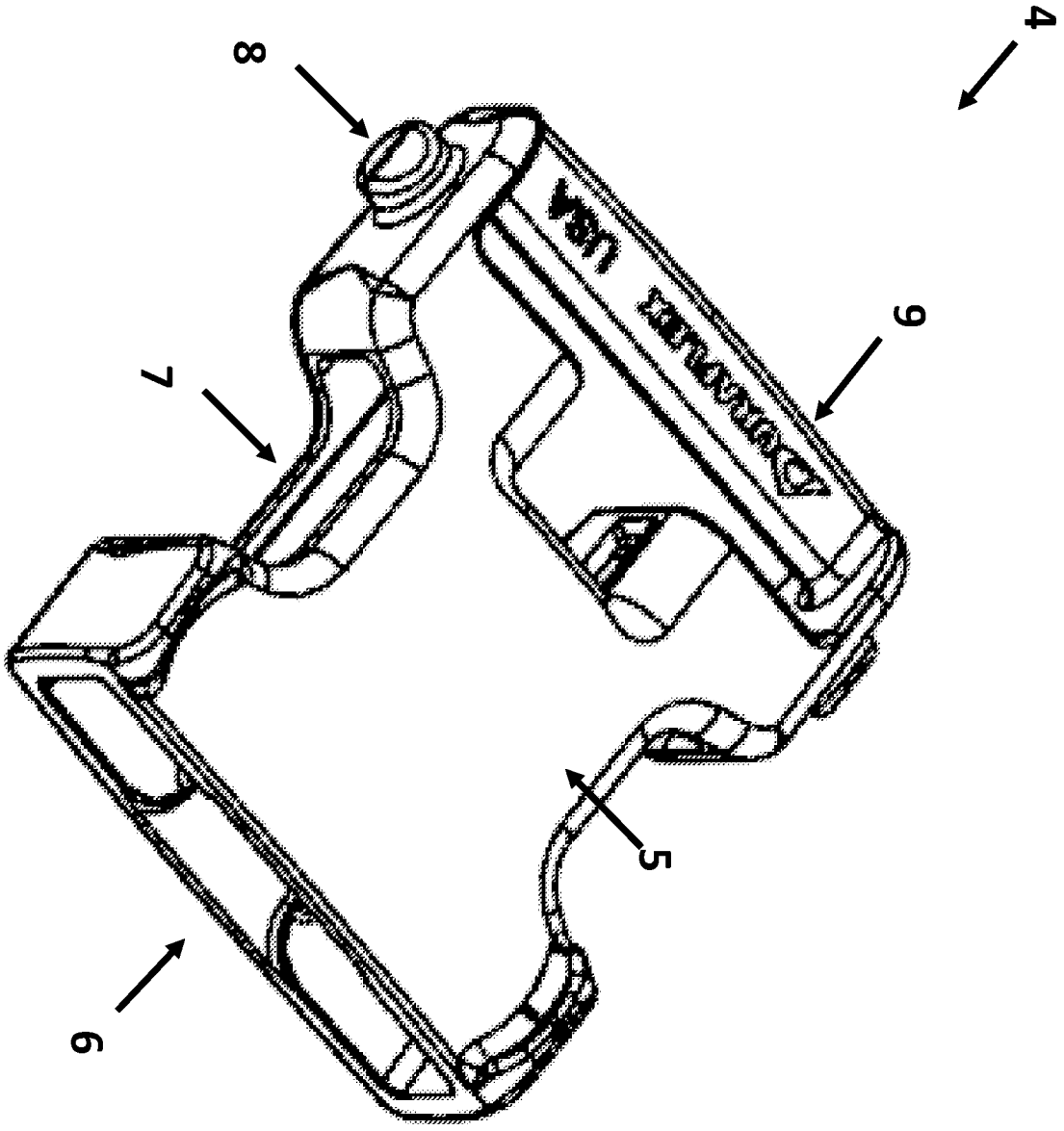
FIG. 4 is an exemplary illustration of a first portion of a release lever buckle.
Figure 5:
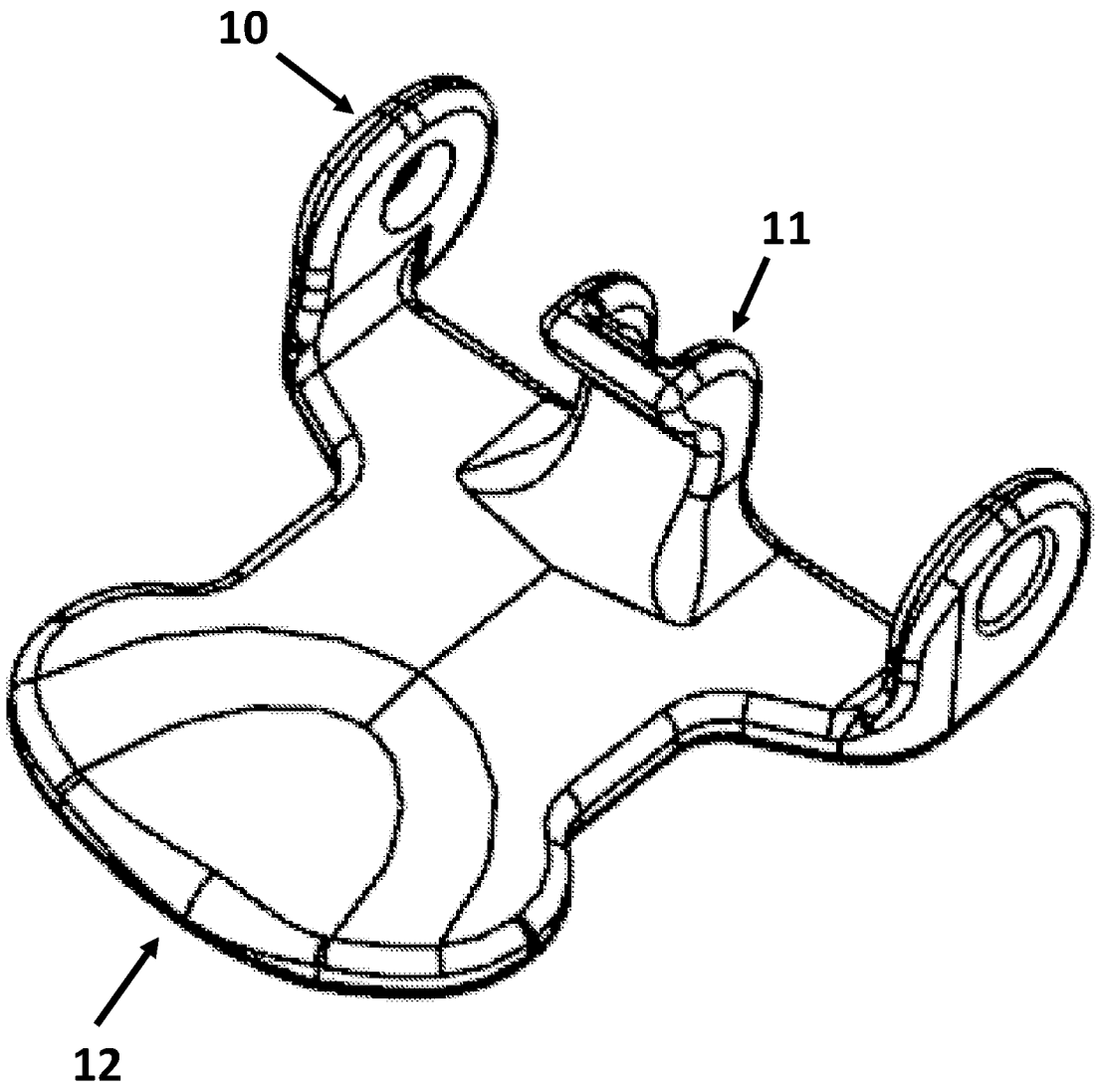
FIG. 5 is an exemplary illustration of a lever.

In FIGS. 2, 4 and 5, the first portion 4 includes the lever 10 that is used to release the second portion 13. The lever 10 is attached to the first portion 4 by a fulcrum 8. The lever 10 includes a member 11 that can reach into the hollow body 5 and interact with the actuator 20 (shown in FIG. 7). The lever 10 also includes a tip 12 that is easy for a user to engage. The tip 11 may be wider than the majority of the lever 10, include a raised portion or shaped in a manner that is easier to grip. The surface of the lever 10 may also be treated to improve grip, for example by texturing or coating the lever. The lever 10 may be maximally pulled to an angle of 45 degrees from the first portion 4.

Referring to FIG. 4, the first portion 4 includes a receiving connector 9. In an exemplary embodiment the receiving connector 9 is provided to attach the first portion 4 to a loop, ring or another article. In another embodiment the receiving connector 9 is attached to a portion of webbing having a fixed length. The loop may be made of a portion of the webbing, a ring or some other type of connection.

Figure 6:
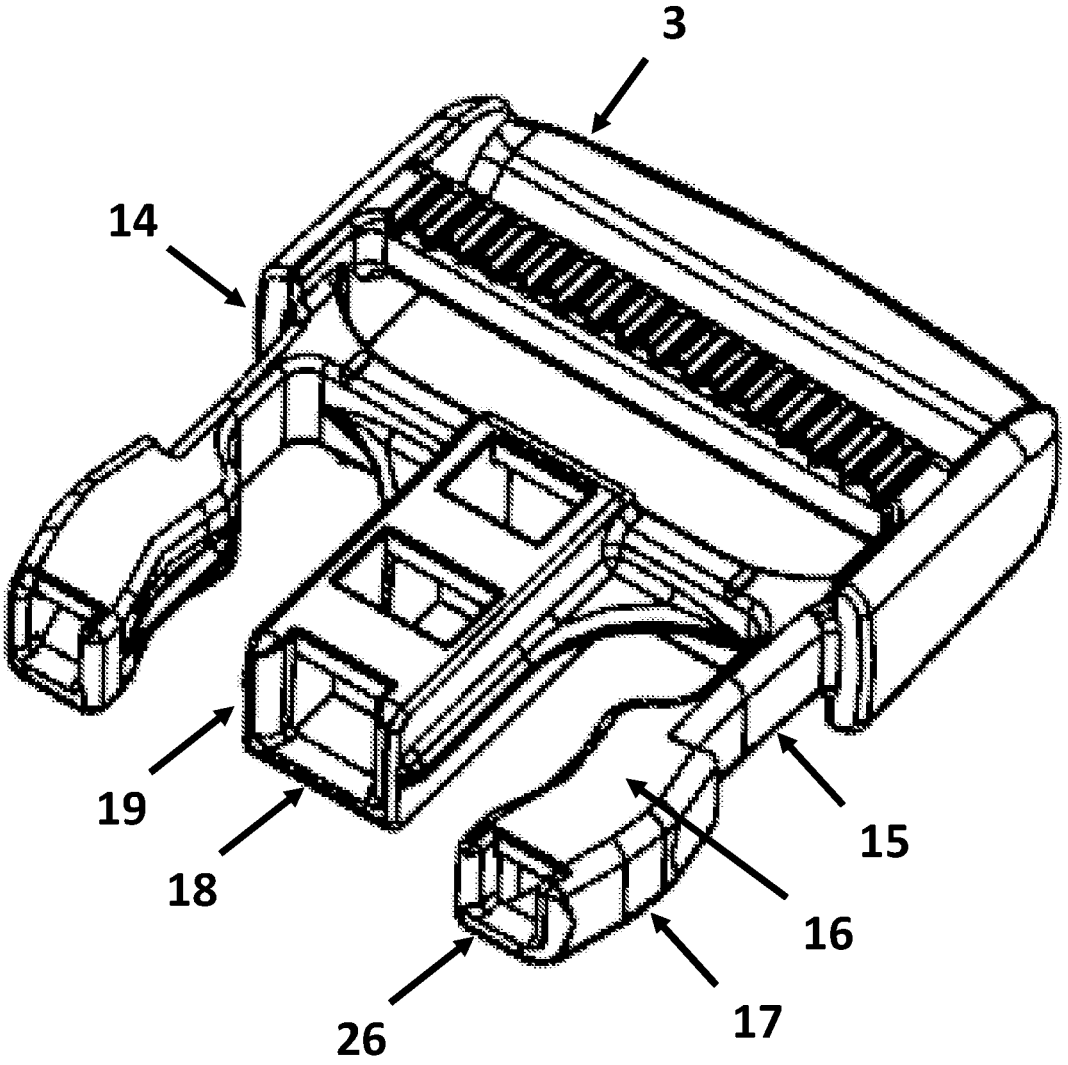
FIG. 6 is an exemplary illustration of a second portion of a release lever buckle.
Figure 7:
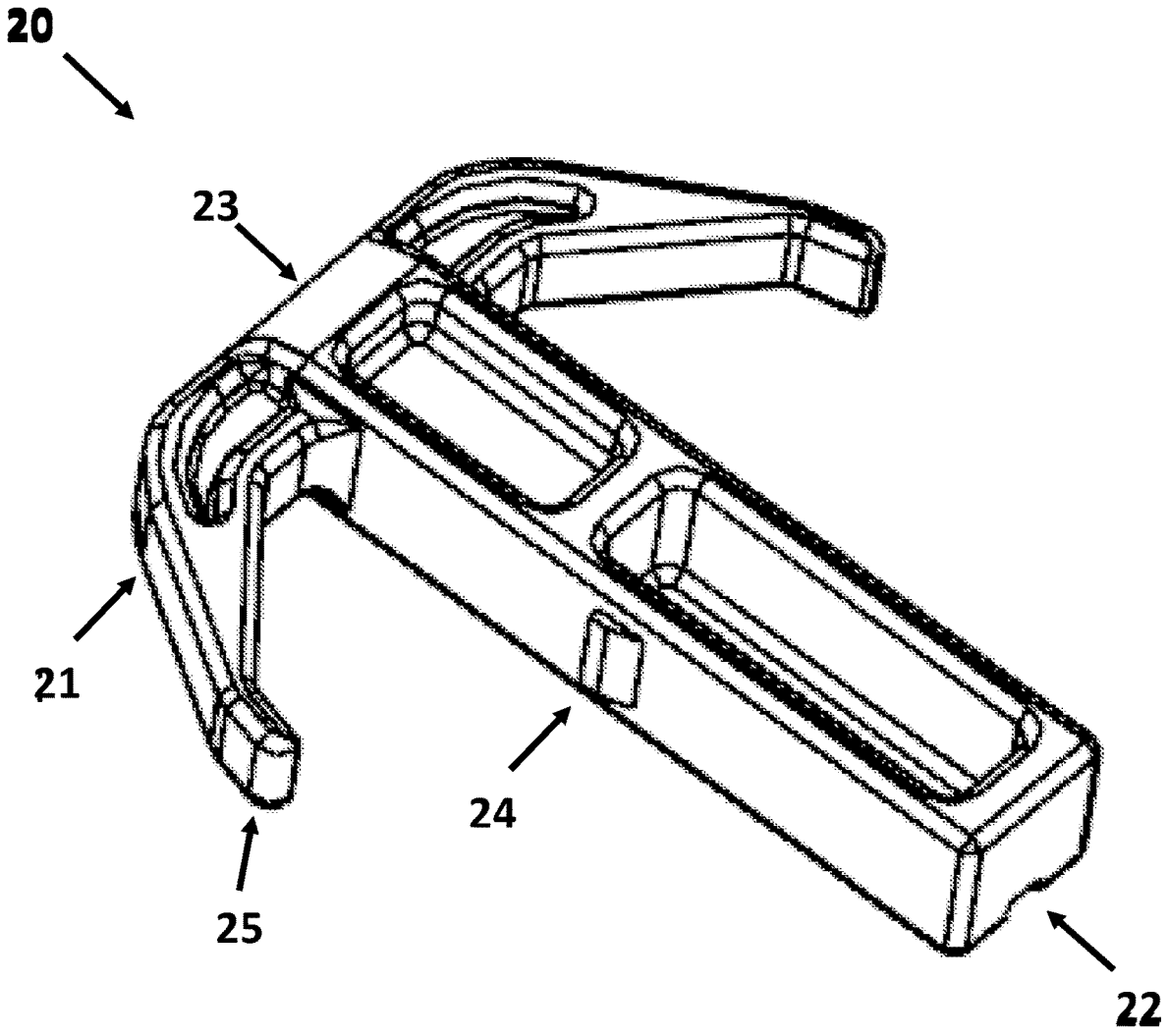
FIG. 7 is an exemplary illustration of an actuator.
Figure 8:
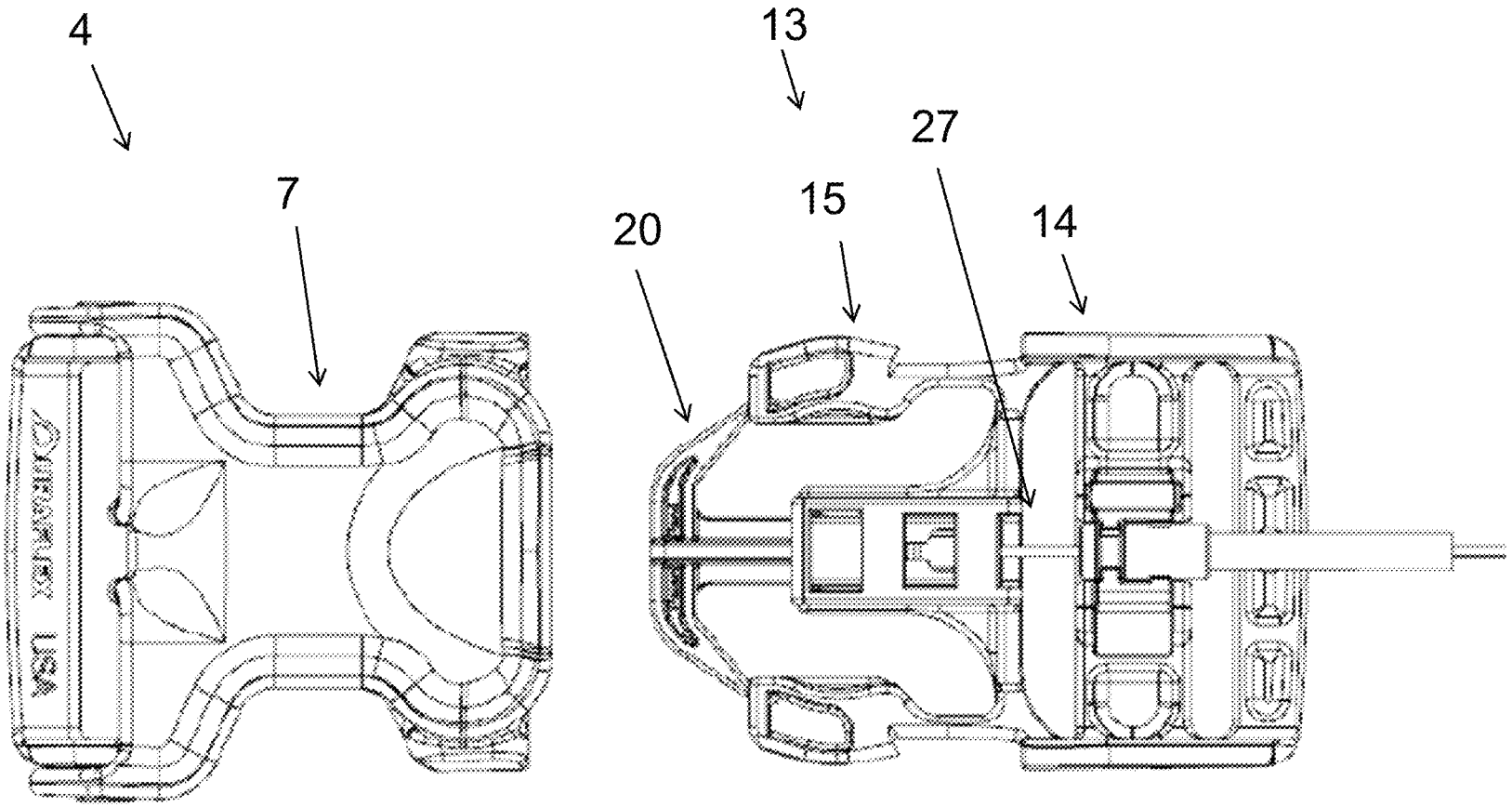
FIG. 8 is an exemplary illustration of a first and second portion of a release lever buckle with a pulling device.
Figure 9:
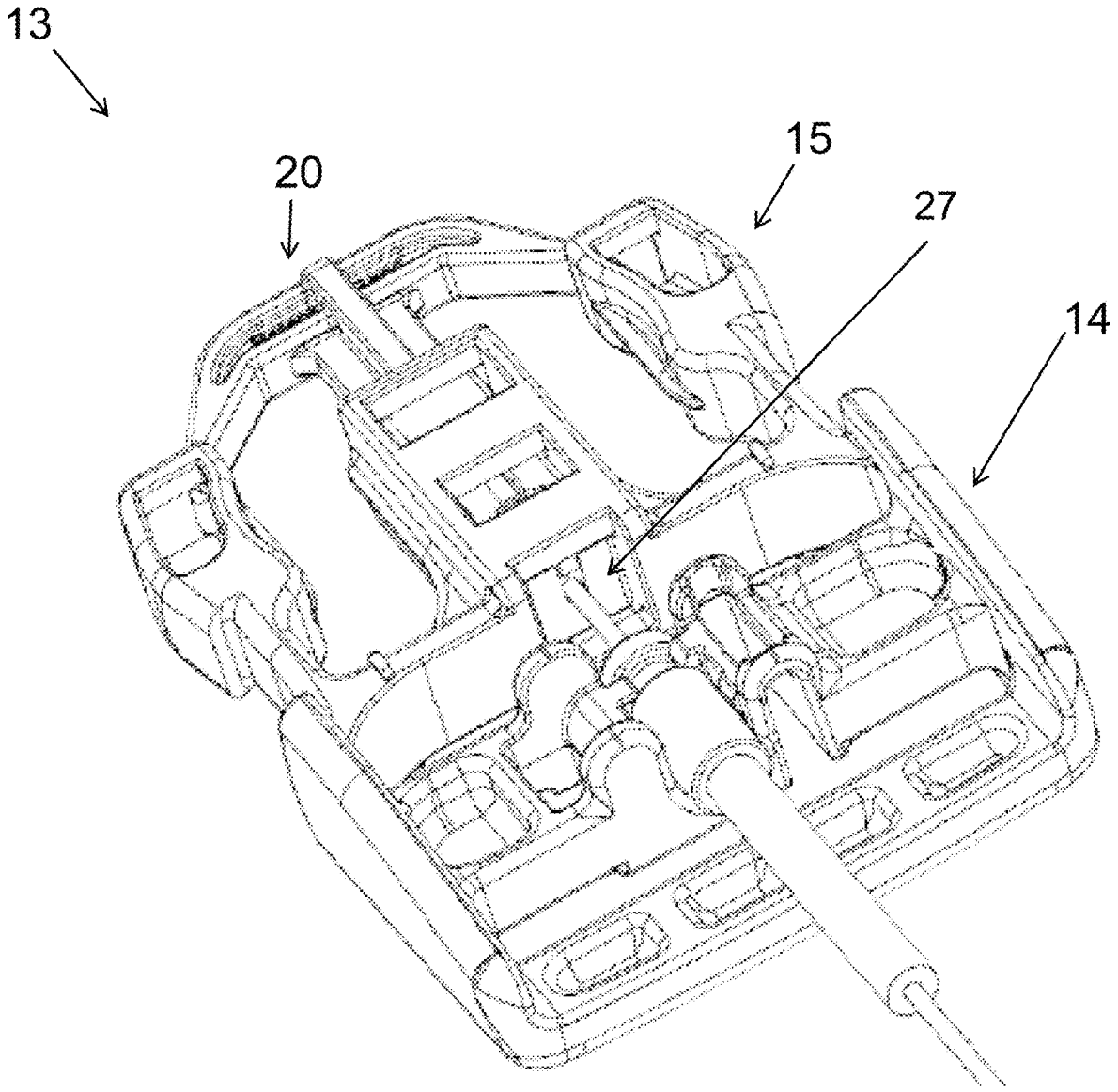
FIG. 9 is an exemplary illustration of a second portion of a release lever buckle with a pulling device.

In FIG. 6, the second portion 13 has one or more locking legs 15 attached to a base 14. As described above the locking legs 15 include a locking end 17 that engages the locking slot 7 of the first portion 4 (shown in FIG. 4). Referring to FIGS. 6 and 7, the first portion 4 also includes an actuator 20 used to manipulate the locking legs 15 via the lever 10. The tail 22 of the actuator 20 is retained in a channel 18 attached to the base 14. The actuator 20 includes a tail 22 extending from the head 23. The actuator 20 has at least one arm 21 extending laterally from the head 23, and the arm(s) 21 terminates in a grip 25.

The actuator 20 is preferably retained in the channel 18 by detents 24 located on the tail 22 and cannot readily move past the lip 19 of the channel 18. The detents 24 and the lip 19 are shaped such that the tail 22 of the actuator 20 can be inserted into the channel 18 but cannot be readily removed from said channel 18. The actuator 20 can travel about ¼ of an inch within the channel 18, or enough to engage and pull the locking legs 15 inward. The profile of the channel 18 may have a variety of shapes including a triangle, square or circle.

Each locking end 17 of the locking leg(s) 15 include a cavity 16. Each locking end 17 may be located on an end or tip of a locking leg 15. The actuator arms 21 engage each locking leg 15 via this cavity 16. In a normal state the locking legs 15 are not deformed and the locking legs 15 push the actuator 20 away from the base 14. When a force is applied to the actuator 20 causing the actuator 20 to retreat toward the base 14 the arms 21 of the actuator 20 will pull on the locking legs 15 causing them to bend inwardly toward one another. Each arm 21 preferably has a grip 25 keeping it continuously in contact with the cavity 16 in the locking leg 15. A tab 26 in the entrance of the cavity 16 interacts and engages with the grip 25, preventing the arm 21 from being removed from the cavity 16.

Referring to FIG. 6, the second portion 13 includes a connector 3. A portion of the webbing 2 is wound through the connector 3 and operates similar to a tension lock. Pulling the webbing 2 at an angle between 20 to 30 degrees above the tension lock causes the webbing 2 to release from the connector 3 and the length can be adjusted.

When the first portion 4 engages the second portion 13 of the buckle the first portion 4 is in the normal state. The locking legs 15 engage the locking slot 7 securing the first portion 4 and the second portion 13 together. The locking legs 15 also push the actuator 20 away from the base 14. This causes the actuator 20 to push on the member 11 charging the lever 10 or bringing the lever 10 into a functional position.

To release the buckle the user may push the locking legs 15 inwardly causing the first portion 4 to disengage from the second portion 13. Alternatively, the user may pull the lever 10. Pulling the lever 10 causes the member 11 to push the actuator 20. The actuator 20 is then pushed toward the base 14 and the arms 21 pull the locking legs 15 inwardly from the locking slots 7. The first portion 4 is then disengaged from the second portion 13.

The buckle assembly 1 is also compatible with the quick release system described in U.S. Pat. No. 9,743,719, herein incorporated by reference. The actuator 20 may accommodate an elongated member and the second portion may be modified such that the quick release assembly does not interfere with the connector 3 or the webbing 2. With the quick release system included one or more buckles could be released by pulling on the quick release system In an exemplary embodiment, the buckle assembly 1 may be manufactured of nylon, polycarbonate, acetal or the like.

In an exemplary embodiment, some or all of the surfaces of the buckle assembly 1 may be treated. This treatment may include wire EDM (Electrical Discharge Machining), polishing or the like. This treatment is designed to reduce friction between the webbing and buckle surface in use.

In an exemplary embodiment, the webbing 2 exiting the buckle assembly 1 may include a capture device. The capture device is attached to the webbing 2 and prevents the webbing 2 from being pulled through the buckle assembly 1 and removed. The capture device may be a knot, bar or loop integrated about an end of the webbing 2.

It should be understood that this description (including the figures) is only representative of some illustrative embodiments. For the convenience of the reader, the above description has focused on representative samples of some possible embodiments, and samples that teaches the principles of the invention. The description has not attempted to exhaustively enumerate all possible variations. That alternate embodiments may not have been presented for a specific portion of the invention, or that further undescribed alternate embodiments may be available for a portion, is not to be considered a disclaimer of those alternate embodiments. One of ordinary skill will appreciate that many of those undescribed embodiments incorporate the same principles of the invention as claimed and others are equivalent.

I claim:

1. A buckle assembly, comprising:

a first portion comprising a hollow body, an open end, at least one locking slot extending through the hollow body, at least one fulcrum and a receiving connector for a webbing;

a second portion comprising at least one locking leg extending from a base, wherein each locking leg includes a cavity in a locking end, and a channel, wherein the hollow body is sized to receive through the open end the second portion and each locking slot is sized to receive the locking end of the corresponding locking leg and to lock the first portion to the second portion;

an actuator slideably received in the channel and comprising a head and at least one arm connected to the head and slideably engaging each cavity, such that applying a force to the actuator along a same axis as the channel causes the at least one arm to draw the at least one locking leg inwardly into an interior of the second portion and disengaging the locking leg from the locking slot; and a lever mounted on the at least one fulcrum configured to apply the force to the actuator along the same axis as the channel when the lever is pulled.

2. The buckle assembly according to claim 1, wherein the first portion includes a fulcrum on a left side and a fulcrum on a right side of the first portion; and the lever is rotateably attached to the fulcrums.

3. The buckle assembly according to claim 1, wherein the actuator has a tail facing the base and the head is opposite the tail; and the lever applies the force to the head.

4. The buckle assembly according to claim 1, wherein a member of the lever extends into the hollow body and engages the actuator when the first portion and second portion are locked.

5. The buckle assembly according to claim 1, wherein the lever includes a member configured to engage the actuator and a tip opposite the member on the lever, the tip is the widest portion of the lever and includes a raised portion.

6. The buckle assembly according to claim 1, wherein the lever is brought into a functional position when the first portion and the second portion are locked.

7. The buckle assembly according to claim 1, wherein the lever has a maximum angle of 45 degrees.

8. The buckle assembly according to claim 1, wherein the actuator is locked within the channel such that the actuator slides without being removed.

9. The buckle assembly according to claim 8, wherein the actuator has at least one detent that interacts with a lip on an opening of the channel.

10. The buckle assembly according to claim 1, wherein the first portion has two locking slots.

11. The buckle assembly according to claim 1, wherein the second portion has two locking legs.

12. The buckle assembly according to claim 1, wherein the actuator has two arms.

13. The buckle assembly according to claim 1, wherein the actuator is connected to a pulling device that runs through the second portion, and the pulling device is configured to pull the actuator toward the base and release the at least one locking leg from the equivalent number of locking slots.

14. A method of locking a buckle assembly as described in claim 1 comprising:

receiving through an open end in a first portion of the buckle a second portion of the buckle, the first portion includes a hollow body, the open end, at least one locking slot extending through the hollow body, at least one fulcrum, a lever rotateably attached to the fulcrum, a member attached to the lever and the second portion includes an actuator, at least one locking leg extending from a base and a channel containing a portion of the actuator;

receiving in the locking slot in the first portion the locking leg;

charging the actuator by the locking leg applying a first force to the actuator along a same axis as the channel thereby pushing the actuator towards the first portion; and charging the lever by applying a second force from the actuator to the member.

15. A method of unlocking a buckle assembly as described in claim 1 having at least two options for unlocking comprising:

a first option including:

applying a first force to a lever attached to a fulcrum included on a first portion of the buckle, the first force is substantially perpendicular to the lever;

moving an actuator in contact with a member by applying the first force to the actuator along a same axis as a channel thereby pushing the actuator towards a second portion of the buckle, wherein the member is attached to the lever and the second portion of the buckle is opposite the first portion of the buckle;

retracting a locking leg from a locking slot, via an interaction between an arm of the actuator and a cavity in a locking end of the locking leg, the first portion includes the locking slot and the second portion includes the locking leg;

a second option including:

applying a second force to the locking leg until the locking leg disengages from the locking slot; and removing the second portion from the first portion.

16. A method of unlocking the buckle according to claim 15 comprising:

a third option including:

pulling the actuator via a cable attached to a tail of the actuator included within the channel, wherein the tail is opposite to a head of the actuator including the actuator's arm;

moving the actuator along the channel in the second portion; and retracting the locking leg from the locking slot, via the interaction between the arm of the actuator and the cavity.

* * * * *